US005350010A

United States Patent [19]

Sawada et al.

[11] Patent Number: 5,350,010

[45] Date of Patent: Sep. 27, 1994

[54] METHOD OF PRODUCING PLANOGRAPHIC PRINTING PLATE SUPPORT

[75] Inventors: Hirokazu Sawada; Tsutomu Kakei; Masaya Matsuki; Akio Uesugi, all of Shizuoka, Japan

[73] Assignee: Fuji Photo Film Co., Ltd., Kanagawa, Japan

[21] Appl. No.: 89,562

[22] Filed: Jul. 12, 1993

[30] Foreign Application Priority Data

Jul. 31, 1992 [JP] Japan ..... 4-223534
Sep. 3, 1992 [JP] Japan ..... 4-258888
Apr. 16, 1993 [JP] Japan ..... 5-112404

[51] Int. Cl.[5] ..... B22D 11/06

[52] U.S. Cl. ..... 164/476; 164/477; 148/551

[58] Field of Search ..... 164/476, 477, 437, 2, 164/91; 148/2, 3, 551

[56] References Cited

U.S. PATENT DOCUMENTS 4,360,401 11/1982 Gray ..... 156/665
4,377,447 3/1983 Bednarz ..... 205/50
4,800,950 1/1989 Crona ..... 164/476
4,818,300 4/1989 Rooy ..... 148/439
5,078,805 1/1992 Uesugi et al. ..... 164/476

*Primary Examiner*—P. Austin Bradley
*Assistant Examiner*—Rex E. Pelto
*Attorney, Agent, or Firm*—Sughrue, Mion, Zinn, Macpeak & Seas

[57] ABSTRACT

A method of producing a planographic printing plate support in which after aluminum is continuously cast directly from molten aluminum into a thin aluminum plate, the aluminum thin plate is subjected to cold rolling, heat treatment and flattening to obtain an aluminum support. The aluminum support is then subjected to surface toughening. The components of the aluminum support are Fe: 0.4%–0.2%,
Si: 0.20%–0.05%,
Cu: not larger than 0.02%, and the Al purity is not smaller than 99.5%. After continuous casting, Fe in a range of from 20% to 90% of the Fe total content exists in a grain boundary and the rest of Fe exists as a solid solution in grains. In this case, it is preferable that in a section perpendicular to the direction of continuous casting, the grain size is in a range of from 2 μm to 500 μm.

10 Claims, 4 Drawing Sheets

METHOD OF PRODUCING PLANOGRAPHIC PRINTING PLATE SUPPORT

BACKGROUND OF THE INVENTION

1. Field of the Invention

The present invention relates to a method of producing a planographic printing plate support and particularly relates to a method of producing an aluminum support having excellent electrolytic roughness.

2. Background

An aluminum or aluminum alloy plate has conventionally been used as a support for an off-set printing plate. In using an aluminum plate, it is generally necessary that the aluminum plate have a moderate adhesive property to a photosensitive material and a moderate water retentivity.

Therefore, the aluminum plate must be toughened so that it can have a uniform and delicately grained surface. Since this toughening treatment influences the printing characteristics and the durability of the printing plate, the effect thereof is an important factor in the production of the plate material.

As a method of toughening an aluminum support for a printing plate, there is generally employed an AC electrolytic etching method in which an ordinary sinusoidal alternating current or a special alternating waveform current such as an alternating rectangular waveform current is applied. Roughening of the aluminum plate is performed utilizing a suitable electrode such as a graphite electrode as a counter electrode. The roughening is generally completed after a single treatment. However, the depth of each pit obtained by such a toughening treatment is relatively shallow so that the resulting aluminum support is not durable. Therefore, various methods have been proposed so that a suitable aluminum plate can be obtained as a printing plate support having a grained surface in which the depth of each of the pits is larger than the diameter of the pit and the pits are evenly distributed.

Included in these methods is a roughening method using a special electrolytic electric source waveform (Japanese Patent Unexamined Publication No. Sho. 53-67507), a method in which the ratio of the quantity of electricity at the positive electrodes to the quantity of electricity at the negative electrodes at the time of electrolytic toughening is controlled with use of an alternating current (Japanese Patent Unexamined Publication No. Sho. 54-65607), a method in which an electric source waveform is applied (Japanese Patent Unexamined Publication No. Sho. 55-25381) and a method in which a combination of the quantities of current conduction per unit area is controlled (Japanese Patent Unexamined Publication No. Sho. 56-29699). Further, methods which include mechanical toughening (e.g., Japanese Patent Unexamined Publication No. Sho. 55-142695) are known.

On the other hand, as a method of producing an aluminum support, there is a method comprising the steps of casting a slab (with the thickness ranging from 400 to 600 mm, the width ranging from 1000 to 2000 mm and the length ranging from 2000 to 6000 mm) by melting and holding an ingot of aluminum; applying a facing attachment to an impurity structure portion of a surface of the slab to thereby cut the impurity structure portion by 3–10 mm; equally heating the slab in a soaking pit at a temperature ranging from 480° C. to 540° C. for a period of 6 to 12 hours in order to remove stress inside the slab and make the structure of the slab uniform and then hot-rolling the slab at a temperature ranging from 480° C. to 540° C. After the slab is hot-rolled into a thickness ranging from 5 to 40 mm, the slab is cold-rolled into a predetermined thickness at room temperature. Then, for homogenizing of the structure and for flattening a plate annealing is performed. Thereafter, cold rolling is carried out to obtain a predetermined thickness, and finally flattening is performed. The aluminum support thus produced is used as a planographic printing plate support.

In the case of electrolytic toughening treatment, however, the treatment is apt to be affected by the aluminum support to be subjected to the treatment. In particular, in producing the aluminum support through the steps of melting/holding, casting, facing and thermal equalizing, there arise a variety of components of a metal alloy contained in the surface layer even in the case where, not only are heating and cooling carried out alternately, but facing (i.e., cutting the surface layer) is provided. Accordingly, this causes the lowering of the yield rate of the electrolytic toughening treatment.

As a method for improving the yield rate in the electrolytic toughening treatment, the inventor of the subject application has proposed a method of producing a planographic printing plate support, characterized by the steps of: forming a thin-plate coil by continuously casting from molten aluminum; applying cold rolling, heat treatment and flattening to the coil to thereby obtain an aluminum support; and then toughening the aluminum support (U.S. Pat. No. 5,078,857).

However, this method still has not significantly improved the yield rate or the aptitude to roughening. In addition, stripe irregularities occur in the toughening-treated surface so that the external appearance is poor.

Accordingly, it was found that the aluminum grain size in the surface of the aluminum plate after final cold rolling or heat treatment greatly affected the quality of the surface after surface roughening.

Accordingly, an object of the present invention is to provide a method of producing a planographic printing plate support in which not only the quality of the material of the aluminum support is improved to thereby improve the yield in the electrolytic roughening treatment but the ability of the planographic printing plate to be toughened is also improved.

Another object is to provide a method which produces a planographic printing plate having excellent surface quality and yield after the surface toughening has been completed.

Yet another object of the invention is to provide a method of producing a planographic printing plate support in which stripe irregularity can be prevented from occurring in the roughened surface to thereby make it possible to produce a planographic printing plate excellent both in the aptitude to roughening and in external appearance.

SUMMARY OF THE INVENTION

The inventors of the present application have eagerly researched the relationship between the aluminum support and the electrolytic toughening treatment, and as a result, they have arrived at the subject invention.

The foregoing object of the present invention can be achieved by a method of producing a planographic printing plate support in which after aluminum is continuously cast directly from molten aluminum into a thin aluminum plate, the thin aluminum plate is subjected to cold rolling, heat treatment and flattening to obtain an aluminum support, and the thus obtained aluminum support is subjected to surface toughening. According to one aspect of the present invention, the components of the aluminum support are Fe: 0.4%–0.2%, Si: 0.20%–0.05%, Cu: not larger than 0.02%, and the Al purity is not smaller than 99.5%, and after continuous casting, Fe in a range of from 20% to 90% of the Fe total content exists in a grain boundary and the rest of the Fe exists as a solid solution in grains.

The above-mentioned method of producing a planographic printing plate support is characterized in that in a section perpendicular to the direction of continuous casting, the grain size is in a range of from 2 μm to 500 μm.

There are various methods for casting the aluminum directly from molten aluminum into a thin aluminum plate to thereby form a thin plate coil. These methods are thin plate continuous casting techniques which include the Hunter method, the 3C method and the Hasley method. Additional methods of producing thin plate coils are disclosed in Japanese Patent Unexamined Publication Nos. Sho. 60-238001, Sho. 60-240360, etc.

A first aspect of the present invention is directed to a method of producing a planographic printing plate support in which after aluminum is continuously cast directly from molten aluminum to thereby form a thin plate coil, the thin plate coil is subjected to cold rolling, heat treatment and flattening to obtain an aluminum support, and the thus obtained aluminum support is subjected to surface toughening, in order to provide an aluminum alloy plate excellent in aptitude for surface-roughening. The Al component and the other alloy components are made to fall within predetermined ranges and the Fe distribution and the grain size after continuous casting are made to fall within predetermined ranges to thereby make it possible to produce a planographic printing plate support superior in surface toughening property with a low cost and with a good yield.

According to a second aspect of the invention, another method is disclosed for producing a planographic printing plate support in which after aluminum is continuously cast by a twin-roller directly from molten aluminum into a thin aluminum plate, the thin aluminum plate is subjected to cold o rolling and heat treatment each once or more and further subjected to flattening to obtain an aluminum support and the thus obtained aluminum support is subjected to surface roughening. This method is characterized in that the Fe content is selected to be in a range from 0.4% to 0.2%, the Si content is selected to be in a range from 0.20% to 0.05%, the Cu content is selected to be not larger than 0.02%, and the Al purity is selected to be not smaller than 99.5%, and in that the grain size of the aluminum plate after the continuous casting is in a range of from 2 μm to 500 μm in a cross section perpendicular to the advancing direction of the casting and the grain size of the aluminum plate after the final cold rolling or annealing is in a range of from 2 μm to 100 μm in the section perpendicular to the advancing direction of the casting and rolling.

As the method in which aluminum is continuously cast by a twin-roller directly from molten aluminum, there are thin plate continuous casting techniques such as the Hunter method, the 3C method, etc., which are used. According to the present invention, by making the grain size fall within a predetermined range when aluminum is continuously cast using a twin-roller from molten aluminum, it is possible to make the distribution of alloy components, which are apt to gather into a grain boundary, stay within a predetermined region. Further, although it is possible to uniformize the distribution of alloy components in the final aluminum plate by transforming the grain boundary in the rolling or annealing step after continuous casting, it is impossible to reduce the influence of the grain boundary to zero, and therefore the grain size of the final aluminum plate is made to fall within a predetermined range. By these methods, a planographic printing plate support having a uniform surface .and excellent in quality can be produced with low cost and good yield.

According to yet another aspect of the present invention, another method is disclosed which includes the steps of casting aluminum, hot-rolling the aluminum, flattening the aluminum to form an aluminum support, and roughening the aluminum support, characterized in that cold rolling is carried out under the condition where the temperature of aluminum subjected to the cold rolling is selected to be in a range of from 100° C. to 250° C. after a coil with a thickness of from 4 mm to 30 mm is formed by the hot rolling, or casting by a twin-roller directly from molten aluminum. The heat treatment is performed at a heating speed of 1° C./sec after the cold rolling is performed until the plate thickness reaches a value ranging from 2 to 5 times greater than a final plate thickness, and then cold rolling is performed until the plate thickness reaches the final plate thickness. Further, the quantity of the reduction of thickness per one pass of the cold rolling is in a range of from 15% to 70% of the plate thickness before the rolling. Further, the quantity of the reduction in thickness per one pass of the cold rolling before the heat treatment is in a range of from 1.0 mm to 3.0 mm. Finally, the molten aluminum contains 0.2% to 0.4% of Fe, 0.05% to 0.2% of Si, 0.02% or less of Cu, and 99.5% or more of Al purity.

The steps of casting aluminum and hot-rolling the aluminum are carried in the following manner. A slab (with the thickness of from 400 to 600 mm, the width of from 1000 to 2000 mm, and the length of from 2000 to 6000 mm) is cast through melting and holding. A facing attachment is applied to the impurity structure portion of the surface of the slab to thereby cut the impurity structure portion by 3–10 mm. Then, the slab is subjected to thermal equalizing treatment in which the slab is held in a soaking pit at a temperature of from 480 to 540° C. for a period of 6 to 12 hours in order to reduce stress in the inside of the slab and homogenize the structure. Then, the slab is hot-rolled at a temperature ranging from 480 to 540° C. After the slab is hot-rolled into a thickness of from 4 to 30 mm, the slab may be cold-rolled, annealed to homogenize the rolled structure, and the like to thereby attain a plate excellent both in homogenization of the structure and in flatness and then cold-rolled into a predetermined thickness. Alternatively, cold rolling and heat treatment may be carried out suitably after the slab is cast continuously from the molten aluminum into the form of a plate with use of two rolls.

In short, cold rolling is carried out under the condition where the temperature of aluminum in cold rolling is in a range of from 100 to 250° C. It is further preferable that heat treatment is carried out at a heating speed of not smaller than 1° C./sec after the cold rolling is performed until the plate thickness reaches a value of from 2 to 15 times as much as a final plate thickness, and then cold rolling is carried out until the plate thickness reaches the final plate thickness.

It is preferable that a method in which a thin-plate coil is formed by casting from the molten aluminum into the form of a plate directly with use of two rolls is used as the casting method of the present invention. Such methods include the Hunter and 3C methods noted above. Further, methods of producing a thin-plate coil have been disclosed in Japanese Patent Unexamined Publication Nos. Sho. 60-238001 and Sho. 60-240360, etc.

To attain an aluminum alloy plate which is susceptible to toughening, the following consideration are present. That is, the quantity of reduction of thickness per one pass in cold rolling may be selected to be in a rate of from 15% to 70% of the original thickness. Alternatively, the quantity of reduction of thickness per one pass in cold rolling before heat treatment may be selected to be in a range of from 1.0 mm to 3.0 mm. Alternatively, the molten aluminum may contain 99.5% or more of Al as the Al component, and predetermined ranges of Si, Cu and Fe as other alloy components as follows: Si=0.05% to 0.2%, Cu=0.02% or less, Fe=0.02 to 0.4%.

DETAILED DESCRIPTION OF THE PREFERRED EMBODIMENTS

Figure 1:
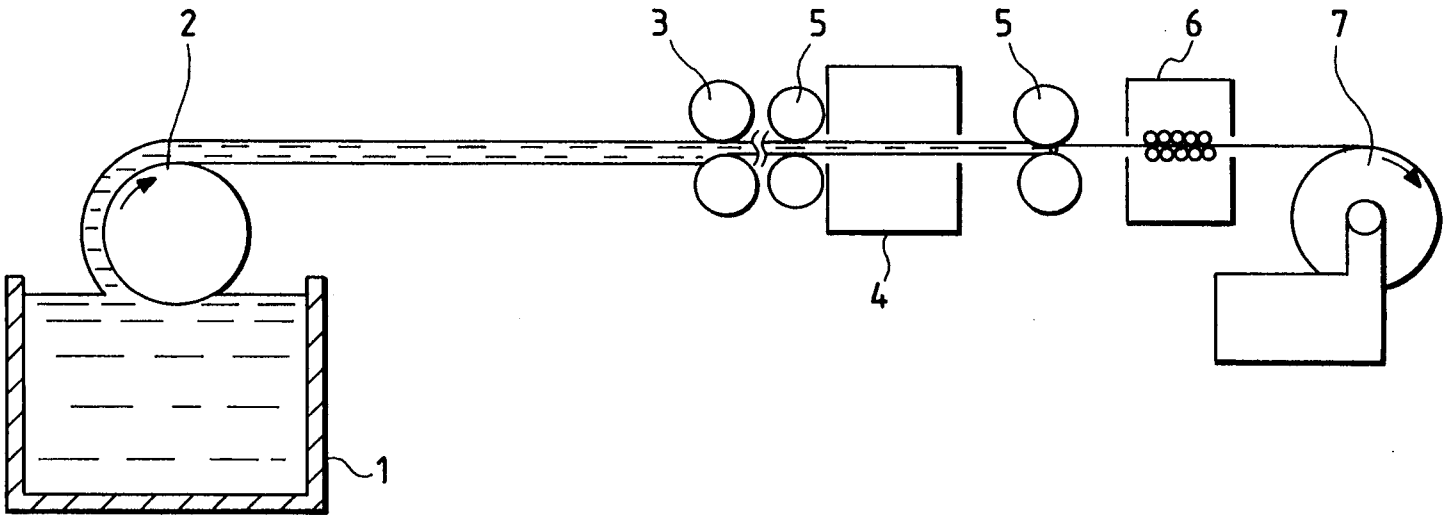
FIG. 1 is a schematical view of an embodiment of a planographic printing plate support producing method according to the present invention.

An embodiment of the aluminum support producing method used in the present invention will be described more specifically with reference to the process schematical view of FIG. 1. Reference numeral 1 designates a melting/holding furnace in which an ingot is melted and held. Molten aluminum is successively delivered from the furnace to a casting machine 2 and a hot rolling mill 3, so that a thin hot-rolled coil is formed directly from the molten aluminum. The coil may be wound up by a collet 7 or may be successively subjected to heater treatment step 4, cold rolling mill 5, and flattening device 6. In the case where the molten aluminum is continuously cast in the casting machine 2 directly into a thin aluminum plate of a thickness not thicker than 10 mm, the hot rolling mill 3 is not necessary.

According to the invention, it is necessary to maintain the aluminum at a temperature of not lower than the melting point thereof in the melting/holding furnace 1. While the temperature varies according to the aluminum alloy components, the temperature is generally 800° C. or higher.

Further, as measures to suppress oxides of the molten aluminum from being produced and to remove alkaline metals, which are of poor quality, there may be carried out inert gas purging, flux treatment or the like if necessary.

Thereafter, casting is carried out by the casting machine 2. Although there are various casting methods, the methods are briefly classified into a movable-mold type and a fixed-mold type. The methods predominantly used in the industrial field are of the movable-mold type including the Hunter method, the 3C method and the like. Although the casting temperature varies according to the type of the mold (i.e., a movable mold or a fixed mold) a temperature of about 700° C. is used. In the case where the Hunter method or the 3C method is employed, the molten aluminum can be cast directly into a thin aluminum plate of a thickness not greater than 10 mm, and the hot rolling mill need not be used. The thin aluminum plate thus obtained through the continuous casting and the hot rolling is subjected to cold roller 5 so as to be rolled into a defined thickness. At this time, to make the grain size uniform, the heat treatment step for intermediate annealing is carried out by heater 4, and cold rolling using a roller 5 may be inserted. Next, flattening is carried out by the flattening device 6 to form an aluminum support having a predetermined flatness and then the aluminum support is surface-toughened. The flattening is carried out, sometimes, while it is experiencing final cold rolling.

As the method of toughening the planographic printing plate support in the present invention, there are used various methods such as mechanical toughening, chemical toughening, electrochemical toughening and combinations thereof.

As the mechanical graining method, there are, for example, a ball graining method, a wire graining method, a brush graining method, a liquid honing method, etc. As the electrochemical graining method, there is generally used an AC electrolytic etching method where a general sinusoidal alternating current or a special alternating current such as a rectangular waveform, etc., is applied. Further, etching with caustic soda may be carried out as a pretreatment of the electrochemical graining.

In the case of electrochemical roughening, the surface is preferably toughened with an aqueous solution mainly containing hydrochloric acid or nitric acid on the basis of an alternating current. A detailed description is provided below.

First, the aluminum support is alkali-etched. Examples of the preferred alkali agent include caustic soda, caustic potash, sodium metasilicate, sodium carbonate, sodium aluminate, sodium gluconate, etc. The concentration, temperature and period thereof are preferably selected to be in a range of from 0.01 to 20%, in a range of from 20 to 90° C. and in a range of from 5 sec to 5 min, respectively. The preferred etching quantity is in a range of from 0.1 to 5 g/m$^2$.

In the case of a support containing a particularly large amount of impurities, the etching quantity is preferably selected to be in a range of from 0.01 to 1 g/m$^2$. Then, de-smutting may be performed if necessary, because alkali-insoluble smut remains on the surface of the aluminum plate subjected to alkali-etching.

Although the pretreatment has been described above, the pretreatment is followed by AC electrolytic etching in an electrolytic solution mainly containing hydrochloric acid or nitric acid in the present invention. The frequency of the alternating electrolytic current is selected to be in a range of from 0.1 to 100 Hz, preferably, in a range of from 0.1 to 1.0 or in a range of 10 to 60 Hz.

The liquid concentration is selected to be in a range of from 3 to 150 g/l, preferably, in a range of from 5 to 50 g/l. The quantity of the molten aluminum in the bath is selected to be not larger than 50 g/l, preferably, in a range of from 2 to 20 g/l. Although additives may be supplied if necessary, it becomes difficult to control the liquid concentration and the like in the case of mass production.

The current density is selected to be in a range of from 5 to 100 A/dm$^2$, preferably, in a range of from 10 to 80 A/dm$^2$. A suitable electric source waveform is selected in accordance with the components of the aluminum support used. A special alternating waveform described in Japanese Patent Postexamination Publication Nos. Sho-56-19280 and Sho-55-19191 is preferably used as the waveform. Such waveform and liquid conditions are selected suitably in accordance with the quantity of electricity, the quality to be required, the components of the aluminum support used, etc.

The electrolytic roughened aluminum is then immersed in an alkaline solution to thereby dissolve smut as a part of smut treatment. Although various kinds of alkali agents such as caustic soda can be used, it is preferable that the alkali treatment be performed in a very short time in the conditions of PH of 10 or higher, a temperature of from 25 to 60° C. and an immersing period of from 1 to 10 sec.

Then, the aluminum is immersed in a solution mainly containing sulfuric acid. As the liquid condition of sulfuric acid, it is preferred that the concentration range from 50 to 400 g/l, one-stage lower than the conventional method, and the temperature range from 25 to 65° C. If the sulfuric acid concentration is not smaller than 400 g/l or if the temperature is not lower than 65° C., corrosion of treating tanks and the like becomes intensive and accordingly the electrochemically toughened grained surface may be destroyed in the case of an aluminum alloy containing 0.3% or more of manganese. If etching is made so that the quantity of solution of the aluminum base is not smaller than 0.2 g/m$^2$, durability against printing is lowered. Accordingly, the quantity of solution of the aluminum base is preferably selected to be not larger than 0.2 g/m$^2$. The positive electrode oxide film is preferably formed on the surface in an amount of from 0.1 to 10 g/m$^2$, preferably, in an amount of from 0.3 to 5 g/m$^2$.

Although the treating condition for positive electrode oxidization cannot be determined simply because it varies widely according to the electrolytic solution used, the electrolytic solution concentration, the liquid temperature, the current density, the voltage and the electrolytic period are generally selected to be in a range of from 1 to 80% by weight, in a range of from 5 to 70° C., in a range of from 0.5 to 60 A/cm$^2$, in a range of from 1 to 100 V and in a range of from 1 sec to 5 min, respectively.

Because the thus obtained grained aluminum plate coated with the positive electrode oxide film is stable in itself and excellent in hydrophilic property, a photosensitive film can be provided thereon directly. If necessary, surface treatment can be further applied thereto. For example, a silicate layer made of alkali metal silicate as described above or an undercoat layer made of a hydrophilic macromolecular compound can be provided. The coating quantity of the undercoat layer is preferably selected to be in a range of from 5 to 150 mg/m$^2$.

Then, a photosensitive film is provided on the aluminum support treated as described above. After plate making is performed through image exposure and development, the plate is set in a printer to start printing.

The following is an example demonstrating the advantages of the method according to a first embodiment of the present invention discussed above.

EXAMPLE 1

Figure 2:
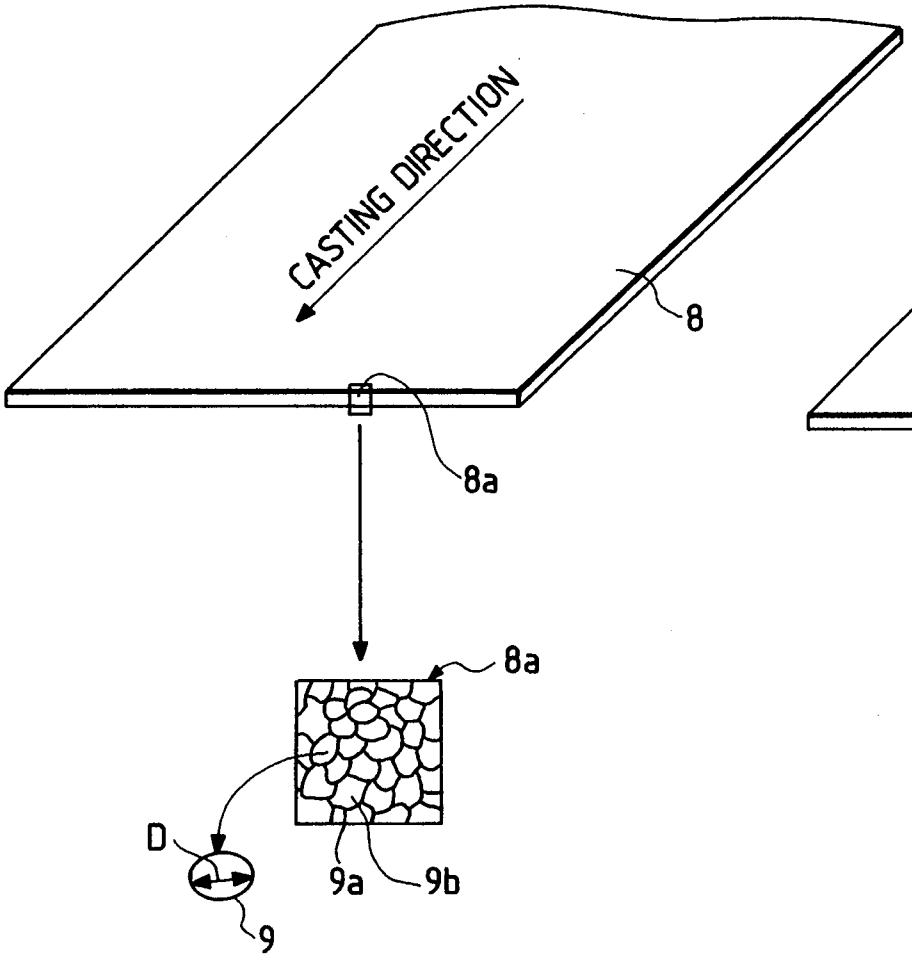
FIG. 2 is a schematical view of the relationship between the grain size and element distribution from the section after continuous casting.

A cast and hot-rolled aluminum plate material with a thickness of 6 mm was formed through a continuous casting thin plate forming apparatus shown in FIG. 1, and then cold-rolled to a thickness of 3 mm. Then, after the annealing step at 400° C. the material was subjected to cold rolling (including flattening) to a thickness of 0.3 mm to form test materials. The resulting plate 8 is illustrated in FIG. 2 which also shows a cross-sectional portion 8*a*. As can be seen by the cross-section, the material consisted of a plurality of grains 9 each having a specific size D defined by the inside grain 9*b* and having a grain boundary 9*a*.

At that time, as shown in Table 1, the compositions of aluminum material and casting conditions were suitably changed so that Examples of the present invention and the Comparative Examples were formed with respect to various combinations of the Fe content in the grain boundary 9*a* and the grain size D as illustrated in FIG. 2.

With respect to the samples obtained in the Examples and the Comparative Examples, observation of grain size in the section perpendicular to the casting direction (see FIG. 2) and observation of element distribution at that portions by means of electronic probe micro analysis (EPMA) were carried out.

TABLE 1

| No. | | Fe | Si | Cu | Fe % in grain boundary | Grain size (μm) |
|---|---|---|---|---|---|---|
| 1 | Example 1 | 0.28 | 0.09 | 0.001 | 50 | 460–100 |
| 2 | Example 2 | 0.34 | 0.17 | 0.001 | 80 | 280–5 |
| 3 | Example 3 | 0.20 | 0.06 | 0.001 | 25 | 120–5 |
| 4 | Example 4 | 0.35 | 0.07 | 0.001 | 85 | 260–30 |
| 5 | Comparative Example 1 | 0.49 | 0.14 | 0.001 | 80 | 460–80 |
| 6 | Comparative Example 2 | 0.30 | 0.40 | 0.001 | 70 | 400–100 |
| 7 | Comparative Example 3 | 0.30 | 0.10 | 0.03 | 50 | 280–50 |
| 8 | Comparative Example 4 | 0.28 | 0.09 | 0.001 | 15 | 160–100 |
| 9 | Comparative Example 5 | 0.28 | 0.09 | 0.001 | 95 | 460–120 |
| 10 | Comparative Example 6 | 0.28 | 0.09 | 0.001 | 50 | 800–400 |
| 11 | Comparative | 0.28 | 0.09 | 0.001 | 50 | 50–0.5 |

TABLE 1-continued

| No. | Fe | Si | Cu | Fe % in grain boundary | Grain size (μm) |
|---|---|---|---|---|---|
| Example 7 | | | | | |

Each of the aluminum plates thus prepared was used as a planographic printing plate support as follows. The support was etched with an aqueous solution of 15% caustic soda at a temperature of 50° C. in the etching quantity of 5 g/m$^2$ and then washed with water. Then, the support was immersed in a solution of 150 g/l of sulfuric acid at 50° C. for 10 sec so as to be desmutted, and was thereafter washed with water.

Then, in an aqueous solution of 16 g/l of nitric acid, the support was roughened electrochemically by using an alternating waveform current described in Japanese Patent Postexamination Publication No. Sho-55-19191. As anode voltage $V_A=14$ volts and a cathode voltage $V_C=12$ volts were used as the electrolytic condition so that the quantity of electricity at the positive electrodes was selected to be 350 coulomb/dm$^2$.

Each of the substrates 1 to 9 thus prepared was coated with the following composition so that the weight of coating after drying was selected to be 2.0 g/m$^2$ to thereby provide a photosensitive layer.

| Photosensitive Solution | |
|---|---|
| N-(4-hydroxyphenyl) methacrylamide/ 2-hyroxyethyl methacrylate/ acrylonitrile/ methyl methacrylate/ methacrylic acid (=15:10:30:38:7 mole ratio) copolymer (mean molecular weight 60000) | 5.0 g |
| hexafluophosphate salt of a condensate of 4-diazophenylamine and formaldehyde | 0.5 g |
| phosphorus acid | 0.05 g |
| Victoria Pure Blue BOH (made by HODOGAYA CHEMICAL Co., Ltd.) | 0.1 g |
| 2-methoxyethanol | 100.0 g |

Each of the photosensitive planographic printing plates thus prepared was exposed to a metal halide lamp of 3 kw at a distance of 1 m for 50 seconds through a transparent negative film in a vacuum printing frame, developed with a developing solution of the following composition and then gummed up with an aqueous solution of gum arabic to thereby prepare a planographic printing plate.

| Devloping Solution | |
|---|---|
| Sodium sulfite | 5.0 g |
| benzyl alcohol | 30.0 g |
| sodium carbonate | 5.0 g |
| sodium isopropylnaphthalenesulfonate | 12.0 g |
| pure water | 1000.0 g |

By using the planographic printing plates thus prepared, printing was performed in a general procedure. The results of Table 2 were obtained.

TABLE 2

| | 1 | 2 | 3 | 4 | 5 | 6 | 7 | 8 | 9 | 10 | 11 |
|---|---|---|---|---|---|---|---|---|---|---|---|
| Result of print test | good | good | good | good | poor | poor | poor | poor | poor | poor | poor |

With respect to the same samples as subjected to the above-mentioned printing test, their surfaces toughened before application of the photosensitive layer were observed with an electron microscope. It was found from the observation that the samples 5 to 11, determined by the printing test as being poor, had non-uniform pits as a result of the toughening process as compared with the samples 1 to 4.

As described above, the planographic printing plate produced by the planographic printing plate support producing method according to the present invention can improve the yield of electrolytic toughening because the scattering in the quality of the aluminum support can be reduced. Furthermore, the planographic printing plate is excellent in printing characteristic because it can be adapted for roughening.

Further, the aluminum support producing process can be optimized to thereby attain reduction in cost of raw materials. Particularly, the present invention greatly contributes to improvement in quality and reduction in cost of the planographic printing plate support.

Another embodiment of the aluminum support producing method used in the present invention will be described more specifically with reference to the process schematical views of FIGS. 3 and 4. Reference numeral 11 designates a melting/holding furnace in which an ingot is melted and held. Molten aluminum is delivered from the furnace to a twin-roller continuous casting machine 12. That is, a thin coil is formed directly from the molten aluminum. The coil may be wound up by a collet 16 or may be successively subjected to a heat treatment, cold rolling and flattening.

According to the invention, it is necessary to maintain the aluminum at a temperature of not smaller than the melting point thereof in the melting/holding furnace 11. The temperature varies according to the aluminum alloy components. The temperature is generally 800° C. or higher.

Further, as measures to suppress oxides of the molten aluminum from being produced and to remove alkaline metals harmful in quality, there may be carried out inert gas purging, flux treatment, etc. if necessary.

Then, casting is carried out by the casting machine 12. Although there are various casting methods, the predominantly used methods in the industrial field are of the movable-mold type including the Hunter method, the 3C method and the like, as noted above. Although the casting temperature varies according to the cooling condition, about 700° C. is optimum. The grain size after continuous casting, the cooling condition, the casting speed, and the rate of change of the plate thickness during casting are controlled and the plate material thus obtained through continuous casting is rolled to a predetermined thickness through the cold rolling mill 13. At this time, to make the grain size uniform, the plate material is subjected to the heat treatment apparatus 14 for intermediate annealing or the like. The cold rolling step performed by the cold rolling mill 13 may be inserted after the annealing. Next, flattening is carried out by the flattening device 15 to give a predetermined flatness to the resulting support as an aluminum support and then the aluminum support is surface-toughened. The flattening is carried out, sometimes, while the final cold rolling is performed.

Figure 4:
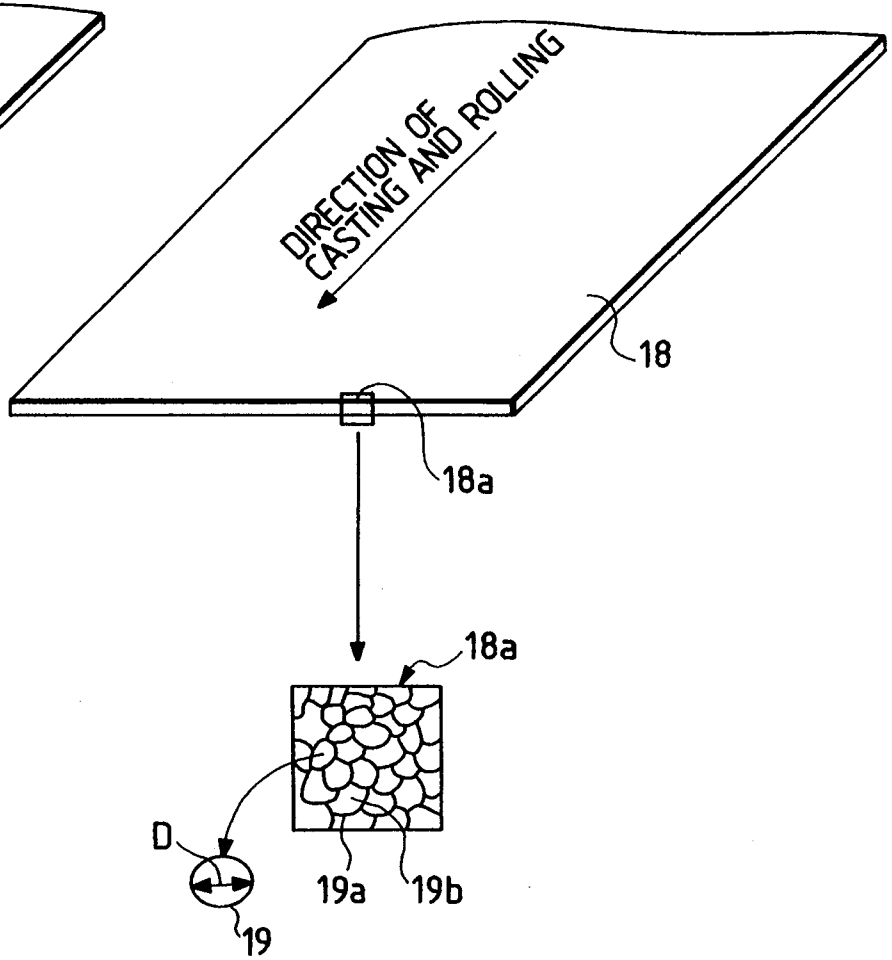
FIG. 4 is a schematical view of the grain size from the section after continuous casting.

The resulting support is illustrated in FIG. 4 which also shows a cross-sectional portion 18*a*. As can be seen by the cross-section, the material consists of a plurality of grains 19 each having a specific size D defined by the inside grain 9*b* and having a grain boundary 9*a*.

The aluminum grain size D in the section perpendicular to the advancing direction of the casting is made to fall within a range of from 2 μm to 500 μm after continuous casting, and to fall within a range of from 2 μm to 100 μm in final state.

The printing plate is then toughened in the manner discussed above concerning the embodiment illustrated in FIGS. 1 and 2.

EXAMPLE 2

Figure 3:
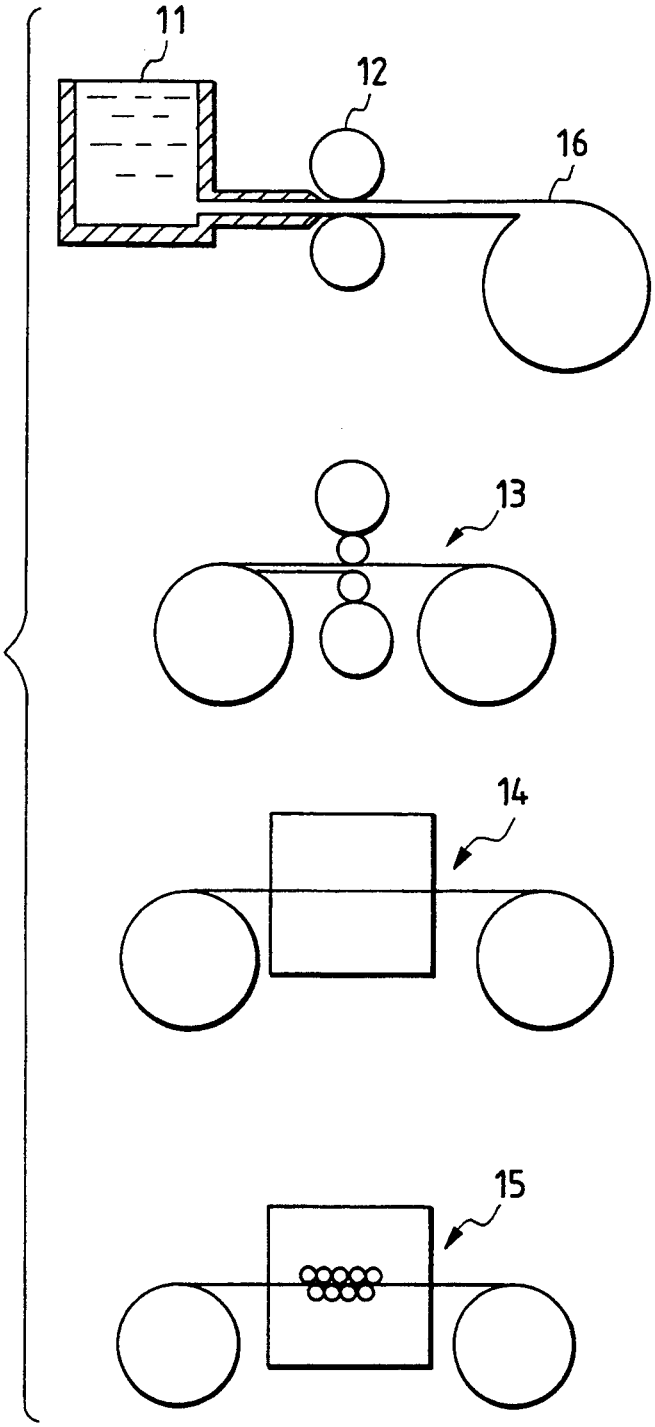
FIG. 3 is a schematical view of another embodiment of a planographic printing plate support producing method according to the present invention.

An aluminum plate material with a thickness of 6 mm was formed through a continuous casting thin plate forming apparatus shown in FIG. 3, and then cold-rolled to a thickness of 3 mm. Then, after the annealing step at 400° C., the material was subjected to cold rolling (including flattening) to 0.3 mm to form JIS1050 materials.

At that time, as shown in Table 3, the compositions of aluminum material, casting conditions, rolling and annealing conditions were suitably changed so that Examples of the present invention and the Comparative Examples were formed with respect to various combinations of the grain size after continuous casting and in the final state. The section perpendicular to the direction of casting and rolling (see FIG. 4), of each of the plate materials, was buffed into a mirror surface and subjected to etching in a 10% solution of hydrofluoric acid, and then the grain size in the surface was observed using a polarizing microscope.

TABLE 3

| No. | | Fe | Si | Cu | Grain size (μm) after casting | Grain size (μm) after final step |
|---|---|---|---|---|---|---|
| 1 | Example 1 | 0.28 | 0.09 | 0.001 | 100–460 | 20–100 |
| 2 | Example 2 | 0.34 | 0.17 | 0.001 | 5–280 | 2–90 |
| 3 | Example 3 | 0.20 | 0.06 | 0.001 | 5–120 | 2–50 |
| 4 | Example 4 | 0.35 | 0.07 | 0.001 | 30–260 | 5–100 |
| 5 | Comparative Example 1 | 0.49 | 0.14 | 0.001 | 80–460 | 10–100 |
| 6 | Comparative Example 2 | 0.30 | 0.40 | 0.001 | 100–400 | 10–100 |
| 7 | Comparative Example 3 | 0.30 | 0.10 | 0.03 | 50–280 | 2–50 |
| 8 | Comparative Example 4 | 0.28 | 0.09 | 0.001 | 400–800 | 30–100 |
| 9 | Comparative Example 5 | 0.28 | 0.09 | 0.001 | 50–0.5 | 2–50 |
| 10 | Comparative Example 6 | 0.28 | 0.09 | 0.001 | 100–400 | 5–400 |
| 11 | Comparative Example 7 | 0.28 | 0.09 | 0.001 | 50–280 | 0.5–120 |

Each of the aluminum plates thus prepared was used as a planographic printing plate support as follows. The support was etched with an aqueous solution of 5% caustic soda at a temperature of 60° C. in the etching quantity of 5 g/m$^2$ and then washed with water. Then, the support was immersed in a solution of 150 g/l of sulfuric acid at 50° C. for 20 sec so as to be desmutted, and then was washed with water.

Then, in an aqueous solution of 16 g/l of nitric acid, the support was roughened electrochemically by using an alternating waveform current described in Japanese Patent Postexamination Publication No. Sho-55-19191. An anode voltage $V_A=14$ volts and a cathode voltage $V_C=12$ volts were used as the electrolytic condition so that the quantity of electricity at positive electrodes was selected to be 350 coulomb/dm$^2$.

The thus produced substrate is coated with a photosensitive solution to obtain a photosensitive planographic printing plate. Here, however, with respect to the substrate before coating with photosensitive solution, evaluation was made on the surface quality with respect to the substrates before application with a photosensitive solution.

This is because if a photosensitive planographic printing plate is subjected to developing after it is exposed through a negative or a positive film (a photosensitive layer is partly removed), the surface of the substrate becomes a non-image portion or an image portion of a planographic printing plate, so that the surface quality of the substrate greatly affects the printing property and visibility of the printing plate.

Table 4 shows the result of an evaluation of the samples before coating with a photosensitive layer shown in Table 3.

TABLE 4

| | 1 | 2 | 3 | 4 | 5 | 6 | 7 | 8 | 9 | 10 | 11 |
|---|---|---|---|---|---|---|---|---|---|---|---|
| Picture quality (Stripe irregularity) | good | good | good | good | poor | poor | poor | poor | poor | poor | poor |

As seen from the above Table, in samples Nos. 5 to 11, using the conventional method stripe irregularity occurred and the product quality was poor. This stripe irregularity was generated because the grain size was not uniform so that alloy components which were apt to deposit in the grain boundary could not be made sufficiently uniform in the rolling and annealing steps. On the contrary, samples Nos. 1 to 4 were excellent in surface quality without any stripe irregularity.

As described above, the planographic printing plate produced by the planographic printing plate support producing method according to the present invention can improve the yield of electrolytic roughening because the scattering in the quality of the aluminum support can be reduced. Furthermore, the planographic printing plate is excellent in that the surface quality after surface roughening is extremely improved and the surface of the plate has no irregularity.

Further, the aluminum support producing process can be optimized to thereby attain reduction in cost of raw materials. Particularly, the present invention greatly contributes to improvement in quality and reduction in cost of the planographic printing plate support.

Yet another embodiment of an aluminum support producing method used in the present invention will be described more specifically with reference to the process schematical view of FIGS. 5–8. Reference numeral 21 designates a melting/holding furnace in which an ingot is melted and held. Molten aluminum is delivered from the furnace to a twin-roller continuous casting machine 22. That is, a thin-plate coil with the thickness of from 4 to 10 mm is formed directly from the molten aluminum and wound up by a coiler 23.

Figure 6:
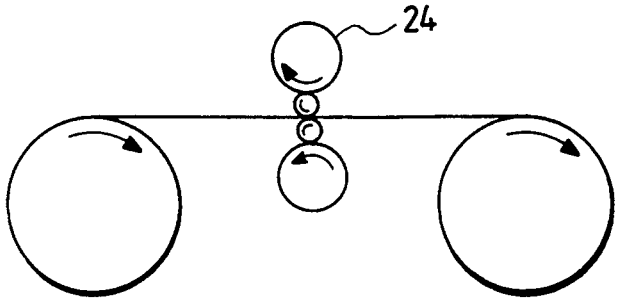
FIG. 6 is a schematical view of the cold rolling step of the planographic printing plate support producing method of the FIG. 5 embodiment of the present invention.
Figure 7:
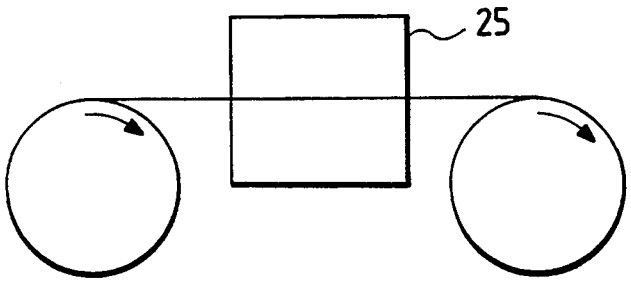
FIG. 7 is a schematical view of the heat treatment step of the planographic printing plate support producing method of the FIG. 5 embodiment of the present invention.
Figure 8:
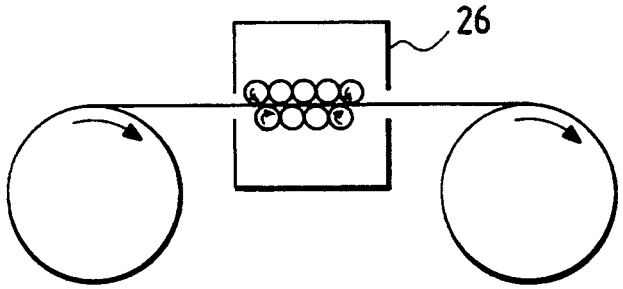
FIG. 8 is a schematical view of the flattening step for the planographic printing plate support producing method of the FIG. 5 embodiment of the present invention.

Thereafter, the coil is subjected to a cold rolling mill 24 as shown in FIG. 6. At this time, the temperature of aluminum is selected to be a range of from 100° C. to 250° C. The cold rolling is carried out until the plate thickness reaches a value of from 2 to 15 times as much as a final plate thickness. At this time, it is preferable that the quantity of reduction of thickness per one pass is selected to be in a range of from 15 to 70% of the plate thickness before the rolling or the quantity of reduction of thickness per one pass before heat treatment is selected to be in a range of 1.0 mm to 3.0 mm. Then, a heating step is performed by heater 25 in FIG. 7. It is preferable that the heat treatment is carried out at a heating speed of 1° C./sec or higher as the heating condition. Final rolling is carried out again in the cold rolling mill 24. At this time, it is preferable that the quantity of reduction of thickness per one pass is selected in a range of from 15 to 70% of the plate thickness before the rolling. Also, it is a matter of course that the temperature of aluminum in the cold rolling is selected to be in a range of 100 to 250° C. Thereafter, the material is subjected to a flattening device 26 as shown in FIG. 8. The plate material thus obtained is subjected to roughening treatment.

According to the present invention, it is necessary to maintain the aluminum at a temperature of not smaller than the melting point thereof in the melting/holding furnace 21. The temperature varies according to the aluminum alloy components. However, the temperature is generally 800° C. or higher.

Further, as measures to suppress oxides of the molten aluminum from being produced and to remove alkaline metals harmful in quality, there may be carried out inert gas purging, flux treatment, etc. if necessary.

Then, casting is carried out by the twin-roller continuous casting machine 22. Although there are various casting methods, the predominant methods used in the industrial field are the Hunter method, the 3C method and the like, as noted above. Although the casting temperature varies according to the system or the alloy, about 700° C. is used. In the case where the Hunter method or the 3C method is employed, rolling can be carried out between the two rolls while the molten aluminum is solidified. When the element distribution in a section of the plate material obtained in this stage is observed by electron probe micro analysis (hereinafter referred to as EPMA), the element distribution is uneven both in the direction of thickness and in the direction of width. This causes a defect in which roughening becomes uneven in the final product. Therefore, rolling is carried out by the cold rolling mill 24 under the condition that the temperature of aluminum is in a range of 100° C. to 250° C. By this condition, the element distribution can be made even both in the direction of thickness and in the direction of width.

At this time, to make the grain size uniform, it is effective that the heating for intermediate annealing is carried out at a heating speed of 1° C./sec or higher as described above and that the rate of reduction of thickness in the cold rolling 4 is selected to be in a range of from 15 to 70% or the quantity of reduction of thickness is selected to be in a range of from 1.0 to 3.0 mm. Then, flattening is carried out by the flattening device 26 to thereby provide a predetermined flatness to the resulting support as an aluminum support to be roughened. The flattening may be carried out so that the final cold rolling is included in the above-mentioned condition.

The printing plate is then toughened in the manner discussed above concerning the embodiment illustrated in FIGS. 1 and 2.

EXAMPLES 3–5 and COMPARATIVE EXAMPLES 6 and 7

Figure 5:
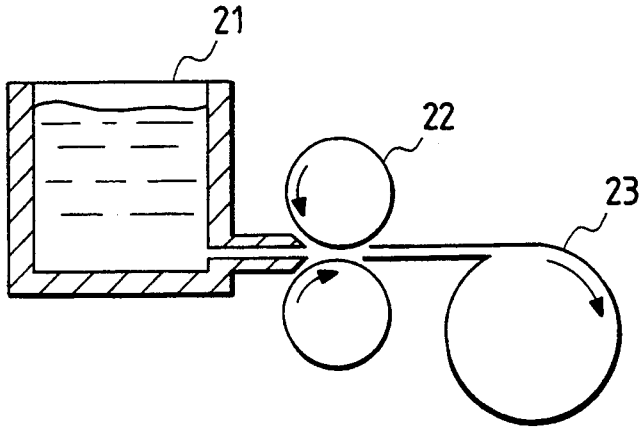
FIG. 5 is a schematical view of the continuous casting step of the planographic printing plate support producing method according to yet another embodiment of the present invention.

An aluminum plate material with a thickness of 7 mm was formed through a continuous casting apparatus shown in FIG. 5, and then cold-rolled to thereby set the thickness in a value of 3 mm. Test materials which were rolled under the condition that the temperature of aluminum in cold rolling was in a range of from 100° C. to 250° C. were prepared as Examples 3, 4 and 5, respectively. Test materials which were rolled under the condition that the temperature of aluminum was lower than 100° C. or higher than 250° C. were prepared as Comparative Examples 6 and 7, respectively. Thereafter, the respective test materials were annealed at 400° C. and then cold-rolled (as well as remedied) into 0.3 mm.

The temperature in rolling was measured by using a non-contact thermometer and high-response thermopaint. Classification of the test materials and results of observation of the element distribution by EPMA are shown in Table 5.

TABLE 5

| Sample No. | Example | Cold Rolling Temperature (°C.) | Result of Observation of Element Distribution |
|---|---|---|---|
| 1 | Example 3 | 101 | No irregularity |
| 2 | Example 4 | 204 | No irregularity |
| 3 | Example 5 | 250 | No irregularity |
| 4 | Comparative Example 6 | 50 | Irregularity |
| 5 | Comparative Example 7 | 280 | Irregularity |

Each of the aluminum plates thus prepared was used as a planographic printing plate support as follows. The support was etched with an aqueous solution of 15% caustic soda at a temperature of 50° C. in the etching quantity of 5 g/m$^2$ and then washed with water. Then, the support was immersed in a solution of 150 g/l of sulfuric acid at 50° C. for 10 sec so as to be desmutted, and then was washed with water.

Then, in an aqueous solution of 16 g/l of nitric acid, the support was toughened electrochemically by using an alternating waveform current described in Japanese Patent Postexamination Publication No. Sho. 55-19191. An anode voltage $V_A=14$ volts and a cathode voltage $V_C=12$ volts were used as the electrolytic condition so that the quantity of electricity at positive electrodes was selected to be 350 coulomb/dm$^2$.

Each of the substrate samples 1 to 5 thus prepared was coated with the following composition so that the weight of coating after drying was selected to be 2.0 g/m$^2$ to thereby provide a photosensitive layer.

| Photosensitive Solution | |
|---|---|
| N-(4-hydroxyphenyl) methacrylamide/ 2-hydroxyethyl methacrylate/ acrylonitrile/ methyl methacrylate/ methacrylic acid (=15:10:30:38:7 mole ratio) copolymer (mean molecular weight 60000) | 5.0 g |
| hexafluophosphate salt of a condensate of 4-diazophenylamine and formaldehyde | 0.5 g |
| phosphorous acid | 0.05 g |
| Victoria Pure Blue BOH (made by HODOGAYA CHEMICAL Co., Ltd.) | 0.1 g |

-continued

| Photosensitive Solution | |
|---|---|
| 2-methoxyethanol | 100.0 g |

Each of the photosensitive planographic printing plates thus prepared was exposed to a metal halide lamp of 3 kw at a distance of 1 m for 50 seconds through a transparent negative film in a vacuum printing frame, developed with a developing solution of the following composition and then gummed up with an aqueous solution of gum arabic to thereby prepare a planographic printing plate.

| Devloping Solution | |
|---|---|
| Sodium sulfite | 5.0 g |
| benzyl alcohol | 30.0 g |
| sodium carbonate | 5.0 g |
| sodium isopropylnaphthalenesulfonate | 12.0 g |
| pure water | 1000.0 g |

By using the planographic printing plates thus prepared, printing was performed in a general procedure. As a result, Table 6 was obtained.

TABLE 6

| | Sample No. | | | | |
|---|---|---|---|---|---|
| | 1 | 2 | 3 | 4 | 5 |
| Result of Printing Test | Good | Good | Good | Poor | Poor |

With respect to the same samples as subjected to the above- mentioned printing test, their surfaces toughened before application of the photosensitive layer were observed with an electron microscope. It was found from the observation that the samples 4 and 5 (Comparative Examples 6 and 7) provided poor printing results as they had uneven pits as a result of the roughening process as compared with the samples 1 to 3 (Examples 3, 4 and 5).

Although this embodiment shows the case where direct continuous casting using two rolls is used as a casting method, it is a matter of course that the moldistribution in components of an alloy in the vicinity of a surface layer can be made uniform by cold rolling at a temperature of from 100° C. to 250° C. even in the case where a method of casting, facing and hot-rolling a slab is used, and that not only the same effect as in the embodiment can be attained but the quantity of facing can be reduced.

EXAMPLES 8 and 9 and COMPARATIVE EXAMPLES 10 and 11

In a continuous casting machine as shown in FIG. 5, aluminum plate materials with a thickness of 7.3 mm were formed and then cold-rolled as follows. When the intermediate plate thicknesses of the samples in hot rolling were 4.0 mm (Comparative Example 10), 1.0 mm (Example 8) and 0.5 mm (Example 9) respectively, the samples were subjected to heat treatment in the condition of a heating speed of 3° C./sec and a peak temperature of 400° C.-one minute. On the contrary, when the intermediate plate thickness of a sample was 0.5 mm, the sample (Comparative Example 11) was subjected to heat treatment in the condition that the heating speed was reduced to 0.9° C./sec. After toughening, the surface conditions of the samples each having a final plate thickness t of 0.24 mm were compared with each other.

The same support roughening condition and the same printing condition as the above Experiment were applied thereto.

The results are shown in Table 7.

TABLE 7

| Sample No. | Example | Rate of Plate Thickness before Heating to Final Plate Thickness | Plate Thickness subjected to Heating (mm) | Heating Speed (°C./sec) | Evaluation for Printing | Presence or Absence of Surface Stripe to Irregularity |
|---|---|---|---|---|---|---|
| 6 | Comparative Example 10 | 16.7 | 4.0 | 3 | Poor | Presence |
| 7 | Example 8 | 4.2 | 1.0 | | Good | Absence |
| 8 | Example 9 | 2.1 | 0.5 | | Good | Absence |
| 9 | Comparative Example 11 | 2.1 | 0.5 | 0.9 | Poor | Presence |

EXAMPLES 12, 13 and 14 and COMPARATIVE EXAMPLES 15 and 16)

In a continuous casting machine as shown in FIG. 5, aluminum plate materials with a thickness of 7.3 mm were formed and then cold-rolled into 0.5 mm. As embodiments of the present invention, there were test materials which were rolled so that the quantities of reduction of the thicknesses in the respective passes in cold rolling were selected to be in a range of from 15% to 70% (Example 12) and in a range of from 1.0 mm to 3.0 mm (Examples 13 and 14) respectively. As comparative examples, there were test materials which were rolled so that the quantities of reduction of the thicknesses were selected to be out of the above mentioned range (Comparative Examples 15 and 16). The surfaces of the respective test materials were observed with use of EPMA to thereby check the distributions of alloy components of Fe and Si. The temperature in cold rolling was measured with thermopaint and adjusted to be in a range of from 150° C. to 200° C.

Table 8 shows the contents of the test materials and the results of observation of the element distributions by EMPA.

TABLE 8

| Sample No. | Example | Cold Rolling Method | Result of Observation by EPMA |
|---|---|---|---|
| 10 | Comparative Example 15 | Rolling was carried out with 5 passes from t7.3 mm to t0.5 mm. Rate of reduction of thickness per one pass was from 18% to 70%. | Uniform |
| 11 | Comparative Example 12 | Rolling was carried out with 25 passes from t7.3 mm to t0.5 mm. Rate of reduction of thickness per one pass was from 5% to 13%. | Stripe Distribution Irregularity |
| 12 | Example 13 | Rolling was carried out | Uniform |

TABLE 8-continued

| Sample No. | Example | Cold Rolling Method | Result of Observation by EPMA |
|---|---|---|---|
| | | with 5 passes t7.3 mm–t5.5 mm–t4.5 mm–3.1 mm–t3.1 mm–t1.6 mm–0.5 mm. The quantity of reduction of thickness per one pass was from 2.9 mm to 1.1 mm. | |
| 13 | Example 14 | Rolling was carried out with 3 passes t7.3 mm–t4.5 mm–t1.6 mm–t0.5 mm. The quantity of reduction of thickness per one pass was from 2.9 mm to 1.1 mm. | Uniform |
| 14 | Comparative Example 16 | Rolling was carried out so that thickness was reduced by a value of from 0.35 mm to 0.25 mm in each of passes of from t7.3 mm to t0.5 mm. | Stripe Distribution Irregularity |

Thereafter, the respective materials were annealed in the condition of a heating speed of 3° C./sec and a peak temperature of 400° C. and then cold-rolled into 0.3 mm to prepare test materials. The thus prepared aluminum plates which were used as planographic printing plate supports were roughened in the same manner as in the above Experiments and then subjected to external appearance evaluation. The results of the evaluation are shown in Table 9.

TABLE 9

| | Sample No. | | | | |
|---|---|---|---|---|---|
| | 10 | 11 | 12 | 13 | 14 |
| Result of External Appearance Evaluation | Good | Stripe Irregularity | Good | Good | Stripe Irregularity |

Each of the substrates 10 to 14 thus prepared was coated with a photosensitive layer by application of a photosensitive solution in the same manner as in the above Experiments and then subjected to exposure, development, printing and coating in the same manner as in the above Experiments. The results of printing are shown in Table 10.

TABLE 10

| | Sample No. | | | | |
|---|---|---|---|---|---|
| | 10 | 11 | 12 | 13 | 14 |
| Result of Printing Evaluation | Good | Poor | Good | Good | Poor |

With respect to the same samples as subjected to the above-mentioned printing test, their surfaces roughened before application of the photosensitive layer were observed with an electron microscope. It was found from the observation that sample the Nos. 11 and 14 having poor results in the printing test had uneven pits as a result of the toughening process compared with the Nos. 10, 12 and 13.

When the molten aluminum contains 0.4% to 0.2% of Fe, 0.2% to 0.05% of Si, 0.02% or less of Cu, and 99.5% or more of Al purity, a desired result can be obtained.

As described above, the planographic printing plate produced by the planographic printing plate support producing method according to the present invention can improve the yield of electrolytic roughening because the moldistribution can be reduced. Furthermore, the planographic printing plate is excellent in printing characteristic because it is susceptible to roughening. As a result, the planographic printing plate is excellent both in printing characteristic and in external appearance because stripe irregularity can be eliminated.

We claim:

1. A method of producing a planographic printing plate support, comprising the following steps:

continuously casting molten aluminum into an aluminum thin plate in a forward direction;

continuously casting molten aluminum into an aluminum thin plate in a forward direction;

cold rolling said plate so that said plate is of a predetermined thickness;

heating said plate;

flattening said plate so that said plate has a predetermined flatness; and roughening a surface of said plate, wherein the Fe content of said plate is selected to be in a range of from 0.4 weight % to 0.2 weight %, the Si content is selected to be in a range of from 0.02 weight % to 0.05 weight %, the Cu content is selected to be in a range of not larger than 0.02 weight %, and the Al purity is selected to be not smaller than 99.5 weight %, and wherein after continuous casting, Fe in a range of from 20 weight % to 90 weight % of the Fe total content exists in a grain boundary and the rest of Fe exists as a solid solution in grains.

2. The method of claim 1, wherein in a section perpendicular to the forward direction, the grain size is in a range of from 2 μm to 500 μm in response to a resultant of said step of multiplying an inverse.

3. A method of producing a planographic printing plate support, comprising the following steps:

continuously casting molten aluminum into an aluminum thin plate in a forward direction;

cold rolling said plate so that said plate is of a predetermined thickness;

heating said plate;

flattening said plate so that said plate has a predetermined flatness; and roughening a surface of said plate, wherein the Fe content is selected to be in a range of from 0.4 weight % to 0.2 weight %, the Si content is selected to be in a range of from 0.20 weight % to 0.05 weight %, the Cu content is selected to be in a range of not larger than 0.02 weight %, and the Al purity is selected to be not smaller than 99.5 weight % and wherein the grain size of the aluminum plate after the continuous casting is in a range of from 2 μm to 500 μm in a section perpendicular to the forward direction and the grain size of the aluminum plate after final cold rolling or annealing is in a range of from 2 μm to 100 μm in said section.

4. A method of producing a planographic printing plate support, comprising the following steps:

continuously casting molten aluminum;

hot rolling said molten aluminum into an aluminum plate having a thickness ranging from 4 mm to 30 mm;

cold rolling said aluminum plate while the temperature of said aluminum plate is in the range of 100°

C. to 250° C. so that said plate is of a predetermined thickness;

heating said plate;

flattening said plate so that said plate has a predetermined flatness; and roughening a surface of said plate.

5. The method of claim 4, wherein said cold rolling is preformed until the predetermined thickness is 2 to 15 times as large as a final plate thickness.

6. The method of claim 5, wherein said heating is performed at a heating rate of 1° C./sec.

7. The method of claim 6, wherein said molten aluminum contains 0.2 weight % to 0.4 weight % of Fe, 0.05 weight % to 0.2 weight % of Si, and 0.02 weight % or less of Cu, with Al purity of 99.5 weight % or more.

8. The method of claim 4, wherein said casting step comprises continuously casting said molten aluminum between two rolls.

9. The method of claim 4, wherein the quantity of reduction of thickness per one pass of said cold rolling is in a range of from 15 weight % to 70 weight % of the plate thickness before said rolling.

10. The method of claim 4, wherein the quantity of reduction of thickness per one pass of said cold rolling before said heat treatment step is in a range of from 1.0 mm to 3.0 mm.

* * * * *